US012669294B2

(12) United States Patent
Lin

(10) Patent No.: US 12,669,294 B2
(45) Date of Patent: Jun. 30, 2026

(54) HEAT DISSIPATION STRUCTURE COMBINING VAPOR CHAMBER WITH HEAT PIPE AND MANUFACTURING METHOD THEREOF

(71) Applicant: TAIWAN MICROLOOPS CORP., New Taipei City (TW)

(72) Inventor: Chun-Hung Lin, New Taipei City (TW)

(73) Assignee: TAIWAN MICROLOOPS CORP., New Taipei City (TW)

( * ) Notice: Subject to any disclaimer, the term of this patent is extended or adjusted under 35 U.S.C. 154(b) by 125 days.

(21) Appl. No.: 18/635,201

(22) Filed: Apr. 15, 2024

(65) Prior Publication Data

US 2025/0290703 A1 Sep. 18, 2025

(30) Foreign Application Priority Data

Mar. 12, 2024 (TW) ..... 113109033

(51) Int. Cl.
*F28D 15/02* (2006.01)

(52) U.S. Cl.
CPC ..... *F28D 15/0275* (2013.01); *F28D 15/0233* (2013.01)

(58) Field of Classification Search
CPC .. F28D 15/0233; F28D 15/0275; F28D 15/04; F28D 2021/0029; F28F 9/0219; H01L 23/427
See application file for complete search history.

(56) References Cited

U.S. PATENT DOCUMENTS

2017/0343295 A1* 11/2017 Lan ..... F28F 9/013
2017/0356694 A1* 12/2017 Tan ..... F28D 15/0266
2023/0213288 A1* 7/2023 Wang ..... F28F 3/02 165/104.26
2025/0151231 A1* 5/2025 Xiong ..... H05K 7/20336

FOREIGN PATENT DOCUMENTS

CN 113390279 A * 9/2021 ..... F28D 15/046

OTHER PUBLICATIONS

Pdf is translation of foreign reference CN-113390279-A (Year: 2021).*

* cited by examiner

*Primary Examiner* — Len Tran
*Assistant Examiner* — Kamran Tavakoldavani
(74) *Attorney, Agent, or Firm* — HDLS IPR SERVICES; Chun-Ming Shih

(57) ABSTRACT

A heat dissipation structure includes a vapor chamber (1), a heat pipe (2) and a working fluid. The vapor chamber (1) includes an upper shell (11), a lower shell (11) correspondingly sealed with the upper shell (11) and a first wick structure disposed on an inner surface of the upper shell (11). A chamber (S) is defined between the upper shell (11) and the lower shell (12). A penetration hole (111) communicating to the chamber (S) is defined on the upper shell (11). A second wick structure (22) includes a revealing section (221) exposed from a hollow slot (211). The working fluid is filled in the chamber (S). An inner diameter of the through hole (131) is smaller than that of the penetration hole (111). The first wick structure (13) is embedded in the hollow slot (211) and attached to the revealing section (221).

10 Claims, 6 Drawing Sheets

HEAT DISSIPATION STRUCTURE COMBINING VAPOR CHAMBER WITH HEAT PIPE AND MANUFACTURING METHOD THEREOF

BACKGROUND OF THE DISCLOSURE

Technical Field

The technical field relates to a heat dissipation structure and a manufacturing method thereof, and more particularly relates to a heat dissipation structure combining a vapor chamber with a heat pipe and a manufacturing method thereof.

Description of Related Art

With the increasing computing speed of electronic components, the generated heat is also rising. To effectively solve the issue of high heat, the industry has developed heat pipes and vapor chambers with excellent thermal conductivity for widespread use. While the heat pipe maintains the direction of the gaseous working fluid flow, the heat conduction is limited by its volume. Additionally, vapor chambers offer a large heating area for direct contact with the heat source. However, the turbulent flow of the gaseous working fluid may restrict heat conduction and dissipation effectiveness.

In order to solve the aforementioned issues, the industry has assembled heat pipes and vapor chambers to constitute a thermal conductive structure. The manufacturing process is as follows. First, the shell plate of the vapor chamber and the heat pipe are welded together. Second, a mandrel is inserted, and metal powder is filled, then subjected to sintering processing in heating equipment, then subjected to sintering processing in heating equipment. Afterward, the mandrel is removed from the heat pipe. Following this, processes such as sealing with another shell plate of the vapor chamber are performed to complete the thermal conductive structure.

Although the thermal conductive structures in the related art possess properties of heat conduction and dissipation, their production process is quite complicated and not conducive to mass production. Furthermore, since the mandrel extends into the bottom end (closed end) of the heat pipe, extracting it from the heat pipe after the sintering process is completed may be challenging. The mandrel adheres to the wick structure over a large area. During the extracting process, the mandrel may easily cause damage or cracking to the wick structure, and that results in poor production yield of the product that needs improvement.

In view of the above drawbacks, the inventor proposes this disclosure based on his expert knowledge and elaborate researches in order to solve the problems of related art.

SUMMARY OF THE DISCLOSURE

This disclosure discloses a heat dissipation structure combining a vapor chamber with a heat pipe and a manufacturing method thereof, in which the vapor chamber and the heat pipe are manufactured separately, and then the heat pipe is directly inserted into the vapor chamber to enhance the easy production of the heat dissipation structure for mass production.

This disclosure is a heat dissipation structure combining a vapor chamber with a heat pipe. The heat dissipation structure includes a vapor chamber, a heat pipe, and a working fluid. The vapor chamber includes an upper shell, a lower shell correspondingly sealed with the upper shell, and a first wick structure disposed on the inner surface of the upper shell. A chamber is defined between the upper shell and the lower shell. A penetration hole communicating with the chamber is defined on the upper shell. A through hole corresponding to the penetration hole is defined on the first wick structure. The heat pipe includes a pipe inserted to and sealed with the penetration hole and a second wick structure disposed on an inner surface of the pipe. A hollow slot corresponding to the through hole is defined on the pipe. The second wick structure includes a revealing section exposed from the hollow slot. The working fluid is filled in the chamber. An inner diameter of the through hole is smaller than an inner diameter of the penetration hole. The first wick structure is embedded in the hollow slot and attached to the revealing section.

This disclosure is a manufacturing method of a heat dissipation structure combining a vapor chamber with a heat pipe. The manufacturing method includes the following steps: A) preparing an upper shell, and processing and forming a penetration hole on the upper shell; B) preparing a first wick structure, and processing and forming a through hole corresponding to the penetration hole on the first wick structure, wherein an inner diameter of the through hole is smaller than an inner diameter of the penetration hole; C) disposing the first wick structure on a surface of the upper shell, and aligning the through hole with the penetration hole; D) preparing a lower shell, and sealing the upper shell and the lower shell correspondingly, wherein a chamber is defined between the upper shell and the lower shell; E) preparing a heat pipe, wherein the heat pipe includes a pipe and a second wick structure disposed on an inner surface of the pipe, processing and forming a hollow slot on the pipe, and exposing a revealing section of the second wick structure from the hollow slot; F) inserting the heat pipe into the penetration hole and sealing the heat pipe with the penetration hole, disposing the revealing section corresponding to the through hole to embed the first wick structure in the hollow slot, and attaching the first wick structure with the revealing section; and G) performing a filling process, and a degassing and sealing processes on a semi-finished product in step F).

In this disclosure, the first wick structure is embedded in the hollow slot and attached to the revealing section to facilitate the entry of the gaseous working fluid into the pipe for heat dissipation. The cooled liquid working fluid then flows through the second wick structure and the revealing section to the first wick structure to facilitate circulation, thereby achieving excellent heat dissipation efficiency of the heat dissipation structure.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIG. 1 to FIG. 5, this disclosure provides a heat dissipation structure combining a vapor chamber with a heat pipe and a manufacturing method thereof. The heat dissipation structure 10 includes a vapor chamber 1, a heat pipe 2 and a working fluid.

Figure 1:
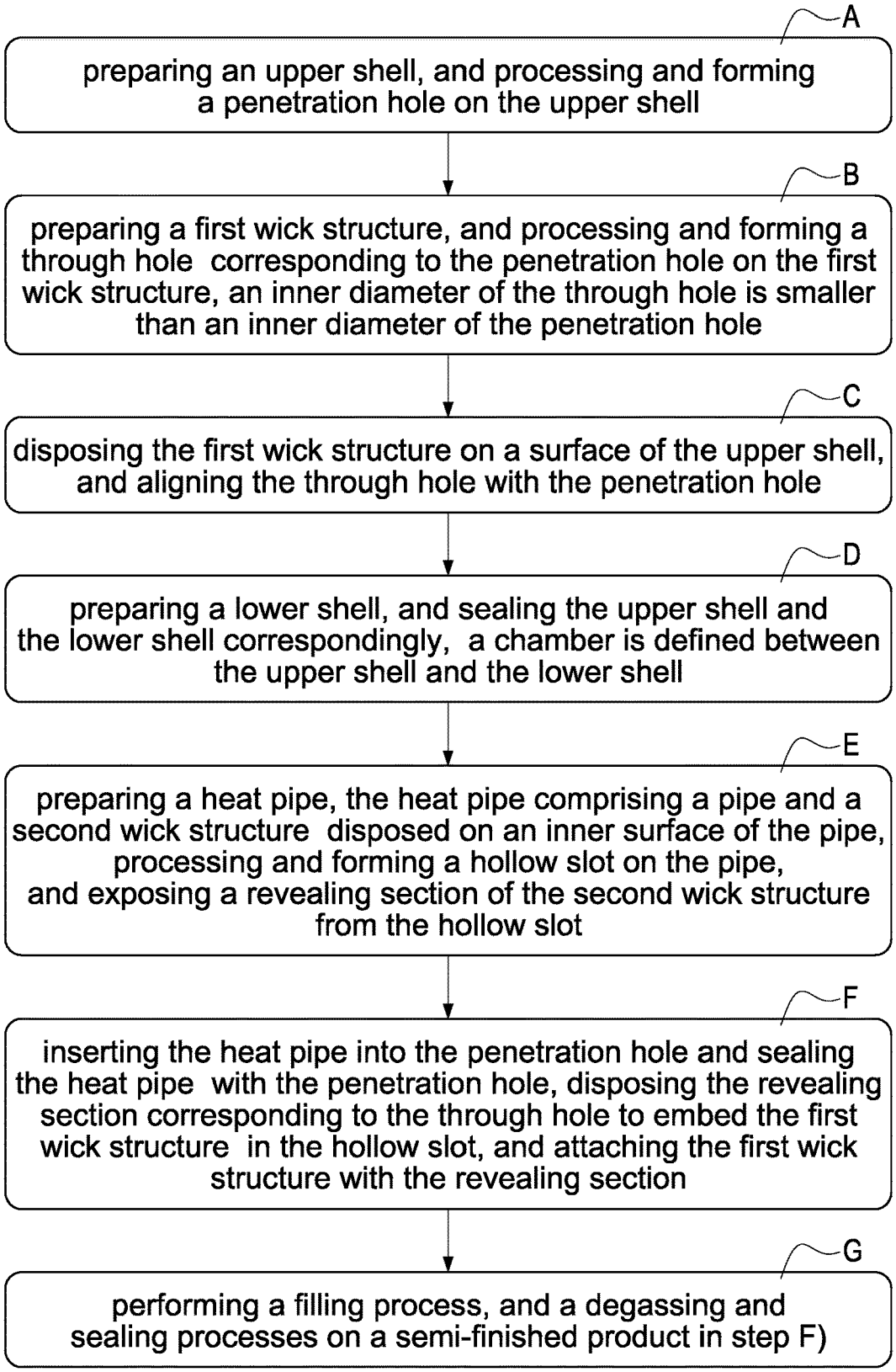
FIG. 1 depicts a flow diagram of the manufacturing method of the heat dissipation structure in this disclosure.

FIG. 1 illustrates the steps of the manufacturing method of the heat dissipation structure 10 in this disclosure. First, referring to step A) in FIG. 1 and FIG. 2 to FIG. 3, the process involves preparing an upper shell 11 and processing one or a plurality of penetration holes 111 on the upper shell 11. The quantity of penetration holes 111 may be determined according to specific requirements, and a single penetration hole 111 may be used for a miniature heat sink.

Figure 2:
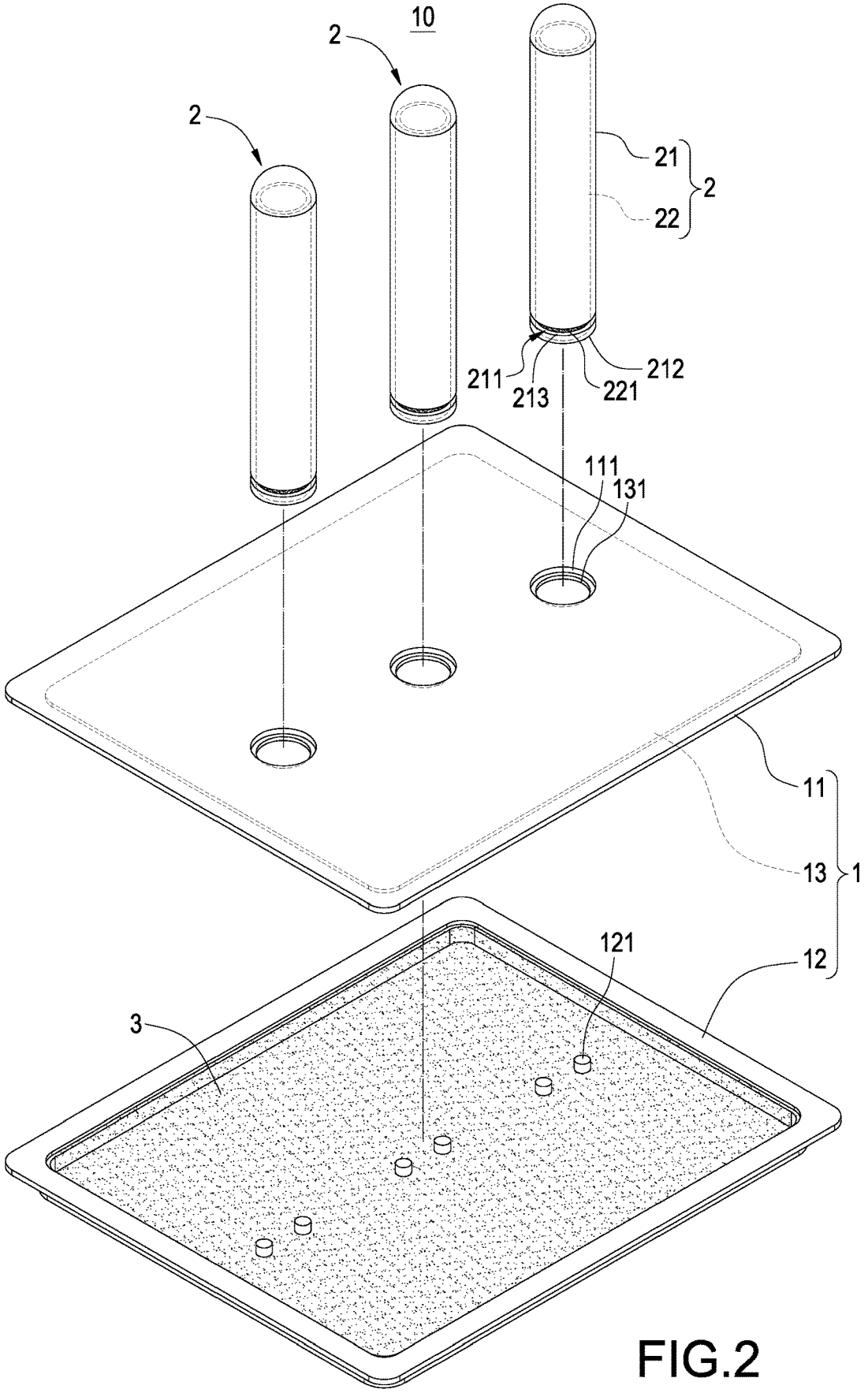
FIG. 2 depicts a perspective exploded schematic view of the heat dissipation structure in this disclosure.
Figure 3:
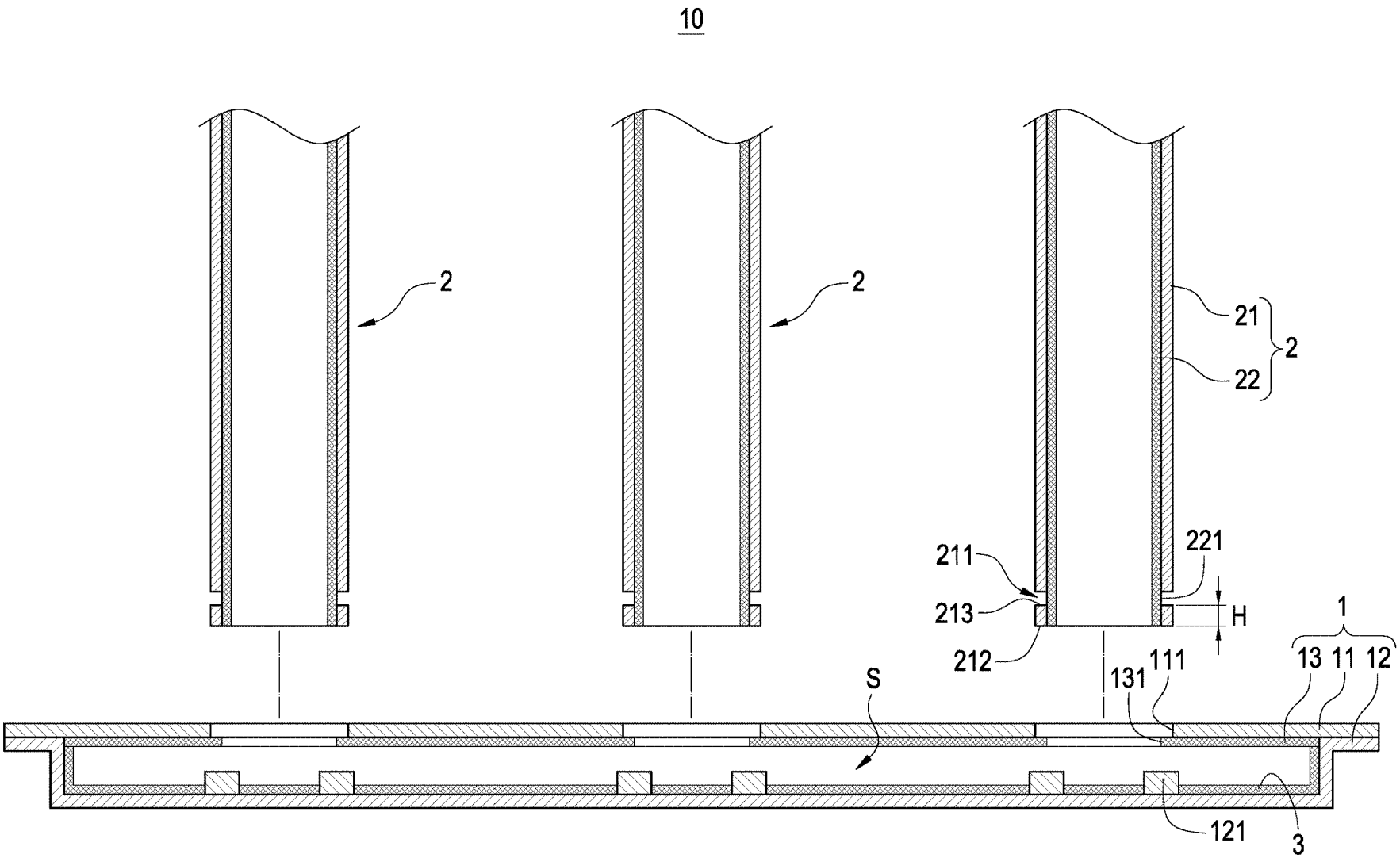
FIG. 3 depicts a cross-sectional exploded view of the heat dissipation structure in this disclosure.
Figure 4:
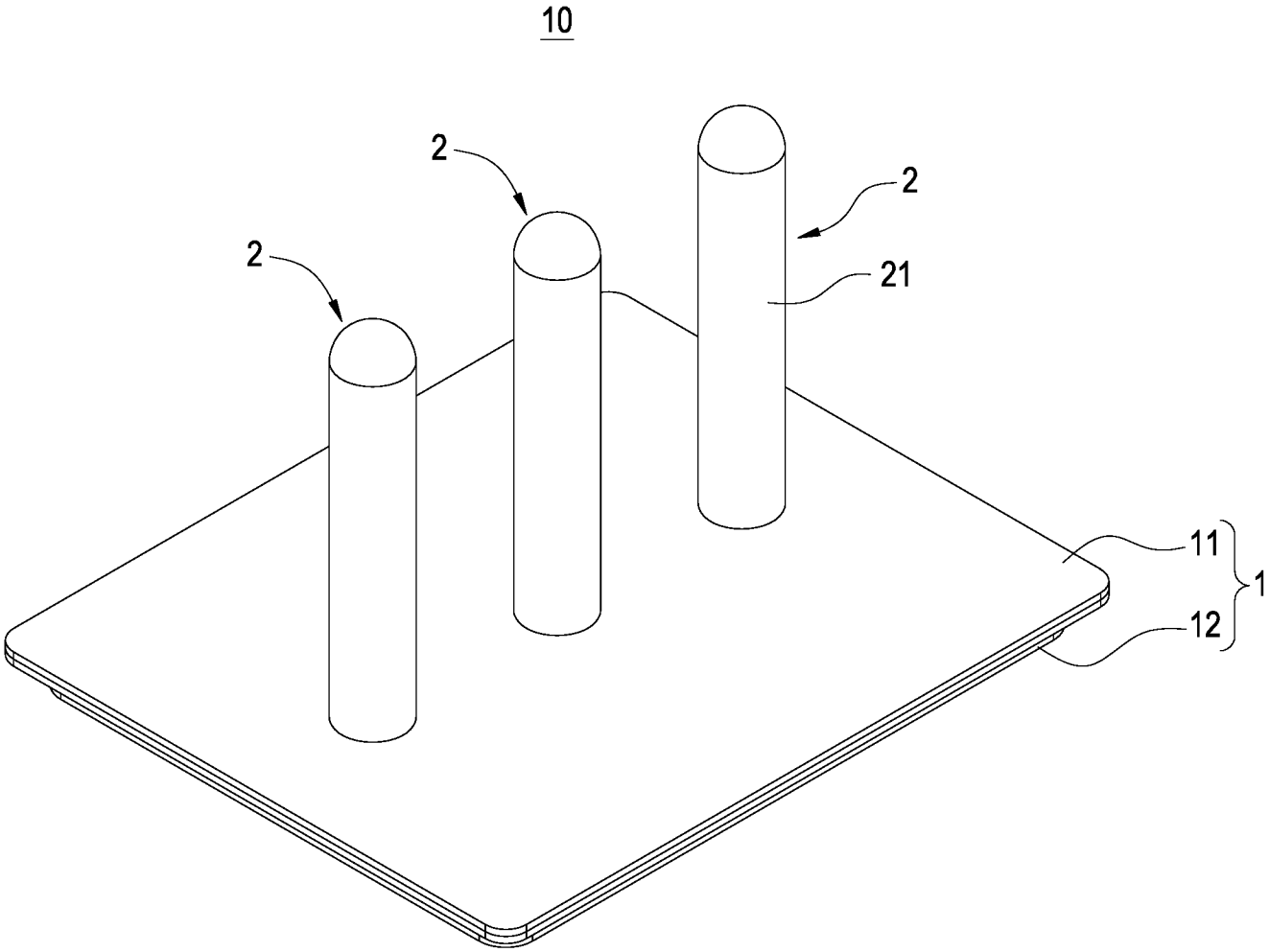
FIG. 4 depicts a perspective assembly view of the heat dissipation structure in this disclosure.
Figure 5:
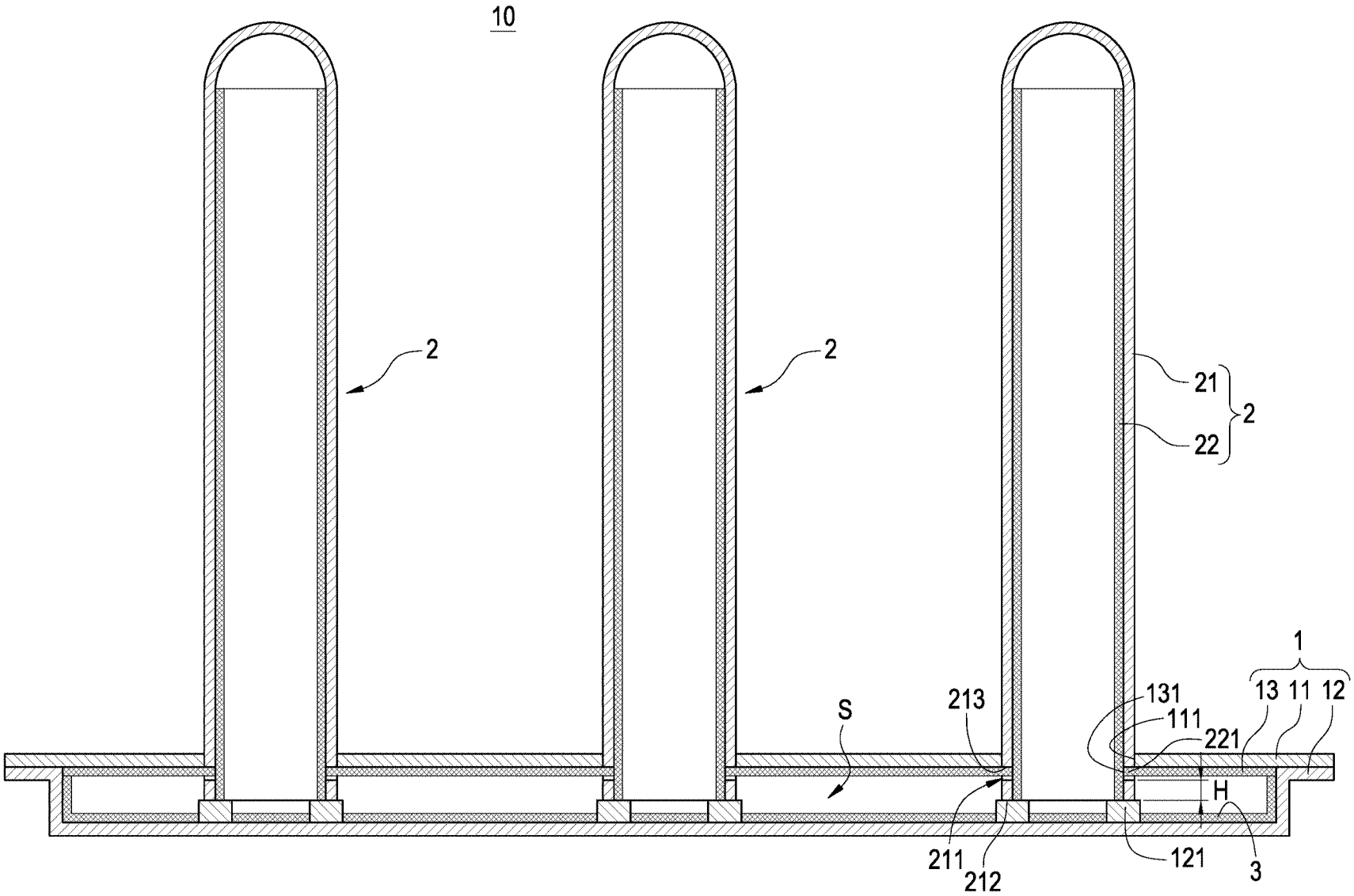
FIG. 5 depicts a cross-sectional assembly view of the heat dissipation structure in this disclosure.

Second, as illustrated in step B) of FIG. 1 and FIG. 2 to FIG. 3, the process involves preparing a first wick structure 13 and punching the first wick structure 13 by a forming mold (not shown in figures), thereby defining a plurality of through holes 131 on the first wick structure 13. Each through hole 131 is located corresponding to each penetration hole 111. An inner diameter of each through hole 131 is smaller than that of each penetration hole 111. The first wick structure 13 includes a metal braided mesh or a combination of a metal braided mesh and a powder sintered body.

Third, as illustrated in step C) of FIG. 1 and FIG. 2 to FIG. 3, the process involves disposing the first wick structure 13 on the surface of the upper shell 11 and aligning the through hole 131 with the penetration hole 111. In more detail, this step involves positioning the first wick structure 13 on the surface of the upper shell 11 to align the through hole 131 with the penetration hole 111. The first wick structure 13 is firmly combined with the inner surface of the upper shell 11 through welding or another fixation method, etc.

Fourth, as depicted in step D) of FIG. 1, and FIG. 2 to FIG. 5, the process involves preparing a lower shell 12. The lower shell 12 is tightly sealed to the upper shell 11, and multiple protrusions 121 are stamped out and extend toward the chamber S. That is, the lower shell 12 includes multiple protrusions 121 extending toward the chamber S. A chamber S is defined between the upper shell 11 and the lower shell 12, and each of the penetration holes 111 communicates with the chamber S.

Furthermore, the upper shell 11 and the lower shell 12 are tightly sealed together, for example, by welding, to form a vapor chamber 1. In addition to the upper shell 11 and the lower shell 12, the vapor chamber 1 further includes a first wick structure 13 placed on the inner surface of the upper shell 11 and a third wick structure 3 positioned on the inner surface of the lower shell 12. The third wick structure 3 includes a powder sintered body, a metal braided mesh, a groove, or any combination thereof. The top edge of the third wick structure 3 is in contact with the first wick structure 13.

Fifth, as depicted in step E) of FIG. 1 and FIG. 2 to FIG. 5, the process involves preparing one or multiple heat pipes 2. The heat pipe 2 includes a pipe 21 and a second wick structure 22 disposed on the inner surface of the pipe 21. A hollow slot 211 is formed by scraping or cutting into the pipe 21. The second wick structure 22 includes a revealing section 221 exposed from the hollow slot 211. The second wick structure 22 includes a metal braided mesh or a combination of a metal braided mesh and a powder sintered body.

The pipe 21 includes a bottom edge 212, and a gap H is defined between a lower edge of the hollow slot 211 and the bottom edge 212. Additionally, the hollow slot 211 includes an annular groove 213 arranged along the entire circumference of the pipe 21, but this is not limited thereto.

Sixth, as shown in step F) of FIG. 1, and FIG. 2 to FIG. 5, each heat pipe 2 is inserted and sealed corresponding to the penetration hole 111. The junction between each heat pipe 2 and the vapor chamber 1 is sealed, for example, by welding, and the bottom edge 212 of each pipe 21 abuts against the tops of the plurality of protrusions 121. Additionally, each hollow slot 211 is disposed corresponding to the position of each through hole 131, and each revealing section 221 is disposed corresponding to each of the through holes 131. Moreover, the inner diameter of the through hole 131 is smaller than that of the penetration hole 111. When the revealing section 221 of the heat pipe 2 is inserted into the through hole 131, the edge of the through hole 131 initially bends and deforms, and then recovers due to the metal braid of the first wick structure 13. That allows the first wick structure 13 to be embedded into the hollow slot 211 to be adhered to the exposed sections 221.

Furthermore, in this embodiment, the step of stamping a plurality of protrusions 121 onto the lower shell 12 is performed before the step of sealing the upper shell 11 and the lower shell 12, but it is not limited thereto. The step of stamping a plurality of protrusions 121 onto the lower shell 12 may be performed after the step of sealing the upper shell 11 and the lower shell 12, or even after the step of inserting and sealing the heat pipe 2 into the corresponding penetration holes 111.

Seventh, as shown in step G) of FIG. 1, the process involves performing filling process and degassing and sealing process on the semi-finished product from step F). That is, the working fluid is filled into the chamber S through a degassing tube (not shown in figures), and degassing and sealing processes are performed to complete the finished product of the heat dissipation structure 10 in this disclosure.

Thus, the vapor chamber 1 and the heat pipe 2 are manufactured separately. Subsequently, the heat pipe 2 is directly inserted into the vapor chamber 1 to avoid issues such as complex manufacturing processes and poor yield. This enhances the ease of fabrication and yield of the heat dissipation structure 10 for mass production.

Furthermore, the first wick structure 13 may be embedded into the hollow slot 211 to be adhered to the revealing section 221 to allow the gaseous working fluid to enter the pipe 21 for heat dissipation. The cooled liquid working fluid then sequentially flows through the second wick structure 22, the revealing section 221, the first wick structure 13, and flows into the third wick structure 3 for recycling to achieve excellent heat dissipation efficiency in the heat dissipation structure 10.

Moreover, the lower shell 12 is extended with a plurality of protrusions 121, which abuts against the bottom edge 212 of the pipe 21, to increase the structural strength of the vapor chamber 1 and eliminate the problem of easy deformation under pressure, thereby enhancing the structure strength of the heat dissipation structure 10.

Figure 6:
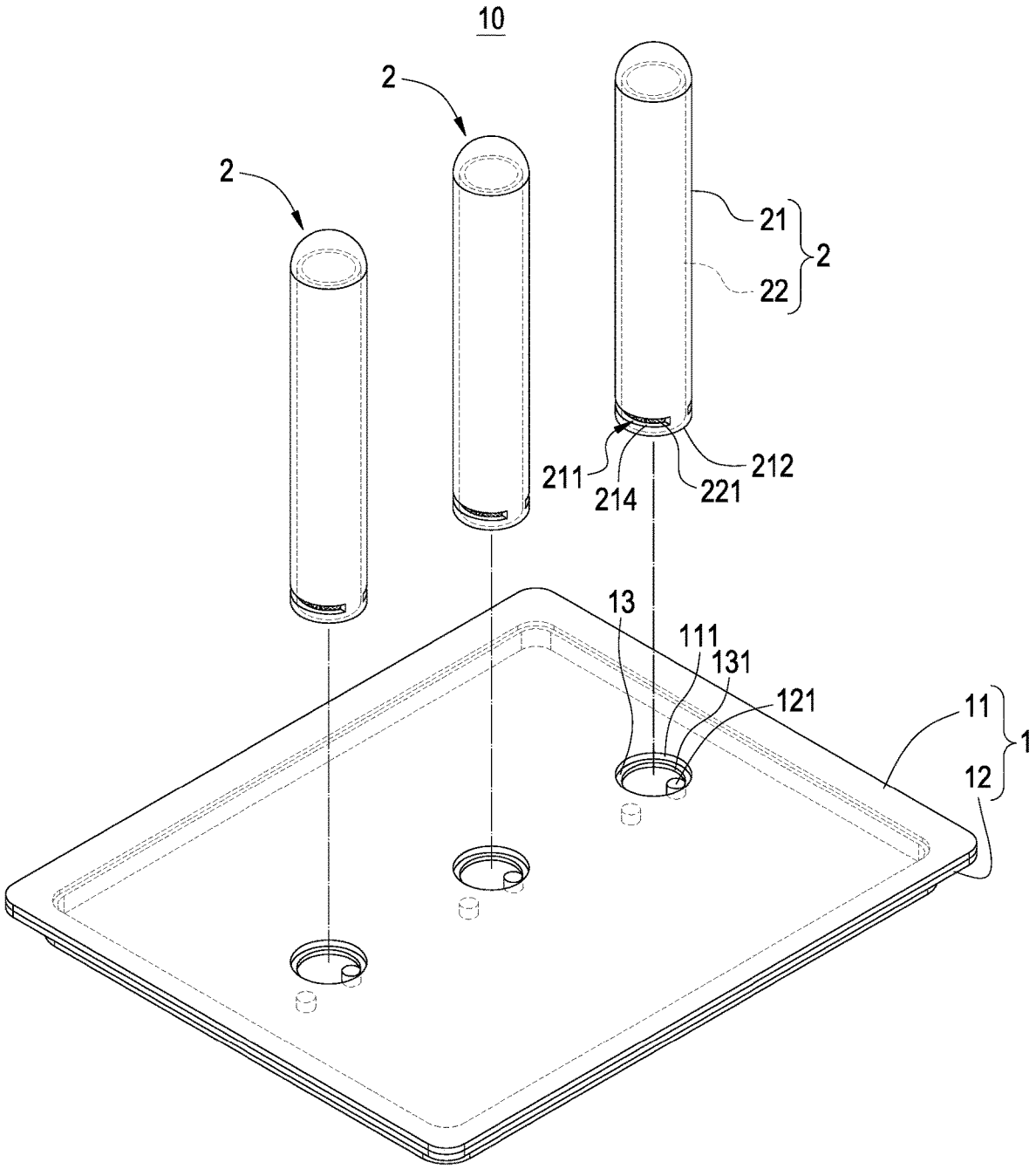
FIG. 6 depicts a perspective exploded view of another embodiment of the heat dissipation structure in this disclosure.

As shown in FIG. 6, it depicts a perspective exploded view of another embodiment of the heat dissipation structure in this disclosure. The embodiment in FIG. 6 is substantially similar to the embodiment in FIG. 1 to FIG. 5. The difference between the embodiment in FIG. 6 and those in FIG. 1 to FIG. 5 is that the hollow slot 211 includes a C-shaped groove 214 arranged along a partial circumference of the pipe 21 to achieve the same functions and effects as those in the embodiment in FIG. 1 to FIG. 5.

While this disclosure has been described by means of specific embodiments, numerous modifications and variations could be made thereto by those skilled in the art without departing from the scope and spirit of this disclosure set forth in the claims.

What is claimed is:

1. A heat dissipation structure, comprising:

a vapor chamber (1), comprising an upper shell (11), a lower shell (12) correspondingly sealed with the upper shell (11), and a first wick structure (13) disposed on an inner surface of the upper shell (11), wherein a chamber (S) is defined between the upper shell (11) and the lower shell (12), a penetration hole (111) communicating with the chamber(S) is defined on the upper shell (11), and a through hole (131) corresponding to the penetration hole (111) is defined on the first wick structure (13);

a heat pipe (2), comprising a pipe (21) inserted to and sealed with the penetration hole (111) and a second wick structure (22) disposed on an inner surface of the pipe (21), wherein a hollow slot (211) corresponding to the through hole (131) is defined on the pipe (21), the second wick structure (22) comprises a revealing section (221) exposed from the hollow slot (211); and a working fluid, filled in the chamber (S);

wherein, an inner diameter of the through hole (131) is smaller than an inner diameter of the penetration hole (111), and the first wick structure (13) is embedded in the hollow slot (211) and attached to the revealing section (221);

wherein the pipe (21) comprises a bottom edge (212), the hollow slot (211) is an opening formed on the pipe (21) not cutting through the bottom edge (212), and a partial portion of the pipe (21) is remained between a lower edge of the hollow slot (211) and the bottom edge (212).

2. The heat dissipation structure according to claim 1, wherein the hollow slot (211) is structured in a manner of the pipe (21) being scrapped or cut.

3. The heat dissipation structure according to claim 1, wherein the first wick structure (13) and the second wick structure (22) comprise a metal braided mesh or a combination of a metal braided mesh and a powder sintered body, respectively.

4. The heat dissipation structure according to claim 1, wherein a gap (H) is defined between the lower edge of the hollow slot (211) and the bottom edge (212).

5. The heat dissipation structure according to claim 1, wherein the lower shell (12) comprises a plurality of protrusions (121) extending toward the chamber (S), and the bottom edge (212) abutting against tops of the plurality of protrusions (121).

6. The heat dissipation structure according to claim 1, wherein the hollow slot (211) is an annular groove arranged along an entire circumference of the pipe (21).

7. The heat dissipation structure according to claim 1, wherein the hollow slot (211) is a C-shaped groove (214) arranged along a partial circumference of the pipe (21).

8. A manufacturing method of a heat dissipation structure, the manufacturing method comprising:

A) preparing an upper shell (11), and processing and forming a penetration hole (111) on the upper shell (11);

B) preparing a first wick structure (13), and processing and forming a through hole (131) corresponding to the penetration hole (111) on the first wick structure (13), wherein an inner diameter of the through hole (131) is smaller than an inner diameter of the penetration hole (111);

C) disposing the first wick structure (13) on a surface of the upper shell (11), and aligning the through hole (131) with the penetration hole (111);

D) preparing a lower shell (12), and sealing the upper shell (11) and the lower shell (12) correspondingly, wherein a chamber (S) is defined between the upper shell (11) and the lower shell (12);

E) preparing a heat pipe (2), wherein the heat pipe (2) comprises a pipe (21) and a second wick structure (22) disposed on an inner surface of the pipe (21), processing and forming a hollow slot (211) on the pipe (21), and exposing a revealing section (221) of the second wick structure (22) from the hollow slot (211), wherein the pipe (21) comprises a bottom edge (212), the hollow slot (211) is an opening formed on the pipe (21) not cutting through the bottom edge (212), and a partial portion of the pipe (21) is remained between a lower edge of the hollow slot (211) and the bottom edge (212);

F) inserting the heat pipe (2) into the penetration hole (111) and sealing the heat pipe (2) with the penetration hole (111), disposing the revealing section (221) corresponding to the through hole (131) to embed the first wick structure (13) in the hollow slot (211), and attaching the first wick structure (13) with the revealing section (221); and G) performing a filling process and a degassing and sealing processes on a semi-finished product in step F).

9. The manufacturing method according to claim 8, wherein the D) further comprises stamping the lower shell (12) to form a plurality of protrusions (121);

and the F) further comprises abutting the bottom edge (212) of the pipe (20) against tops of the plurality of protrusions (121).

10. The manufacturing method according to claim 8, wherein the E) further comprises scraping or cutting the pipe (21) to form the hollow slot (211).

* * * * *